US008333142B1

(12) United States Patent
Karfiol et al.

(10) Patent No.: US 8,333,142 B1
(45) Date of Patent: Dec. 18, 2012

(54) FIREARM SLIDE CAM SURFACE FOR CARTRIDGE FEED

(75) Inventors: Yury Karfiol, Brooklyn, NY (US); John Goliber, Leonia, NJ (US)

(73) Assignee: Kimber IP, LLC, Yonkers, NY (US)

( * ) Notice: Subject to any disclaimer, the term of this patent is extended or adjusted under 35 U.S.C. 154(b) by 156 days.

(21) Appl. No.: 12/980,521

(22) Filed: Dec. 29, 2010

(51) Int. Cl.
*F41A 9/00* (2006.01)

(52) U.S. Cl. ..... 89/196

(58) Field of Classification Search ..... 89/194–197, 89/33.01; 42/14, 16–22
See application file for complete search history.

(56) References Cited

U.S. PATENT DOCUMENTS 255,153 A * 3/1882 Elliott ..... 42/17
875,209 A * 12/1907 Prinke ..... 89/197
1,435,282 A * 11/1922 DeClaye ..... 42/17
1,911,494 A * 5/1933 Floyd ..... 89/137
3,345,770 A * 10/1967 Scanlon, Jr. ..... 42/18
4,461,203 A * 7/1984 Jawdat ..... 89/154
7,322,143 B2 1/2008 Rohrbaugh et al.
8,065,950 B2 * 11/2011 Kaminsky ..... 89/196

* cited by examiner

*Primary Examiner* — Bret Hayes
*Assistant Examiner* — Reginald Tillman, Jr.
(74) *Attorney, Agent, or Firm* — Caesar, Rivise, Bernstein, Cohen & Pokotilow, Ltd.

(57) ABSTRACT

A slide for a semi-automatic pistol is provided where the pistol has a frame, a slide mounted on the frame, a barrel mounted between the slide and the frame, and a magazine for feeding cartridges into the chamber of the barrel. The slide includes a front portion for receiving the barrel where the front portion has a breech face end, a block having an elongate passage for receiving a firing pin mechanism, and a cam surface extending from a lower surface of the block adjacent to the breech face end which functions as a feed ramp for feeding cartridges from the magazine to the chamber. The cam surface is a truncated hemispherical protuberance having a flat surface where the flat surface extends at an angle from the breech face. Positive contact between the breech face and the topmost cartridge is ensured during forward movement of the slide.

2 Claims, 8 Drawing Sheets

FIREARM SLIDE CAM SURFACE FOR CARTRIDGE FEED

BACKGROUND OF THE INVENTION

The present invention is directed to semi-automatic handguns. More particularly, the present invention is directed a semi-automatic handgun having a reliable cartridge feed system.

U.S. Pat. No. 7,322,143 (Rohrbaugh et al.) is directed to a semiautomatic handgun having a frame, a barrel mounted on the frame and a chamber for receiving a cartridge, a slide mounted on the frame and over the barrel, a firing mechanism for striking the cartridge, and a trigger for releasing the firing mechanism. The block of the slide has a protrusion extending from its lower surface. The protrusion has a front wall surface and a tapered surface which decreases in taper from its front to rear end. The width and height of the protrusion are smaller than a corresponding cavity in the frame so that the protrusion travels within the cavity when the slide moves rearwardly and then forwardly during a firing sequence. The function of the protrusion is to strip a live cartridge from the pistol's magazine and to push the live cartridge by contacting an upper portion of the cartridge until the live cartridge reaches an end of a holding portion of the magazine. At this point, the live cartridge displaces upwardly due the magazine spring. The protrusion ensures that there is positive contact between the breech face of the slide block and the live cartridge during forward movement of the slide so that the live cartridge is securely and quickly chambered for firing.

The present invention is directed to an improvement to this design for such a protrusion.

All references cited herein are incorporated herein by reference in their entireties.

BRIEF SUMMARY OF THE INVENTION

In a first embodiment of the present invention, a slide for a semi-automatic pistol is provided having a cam surface for improved cartridge feed. The pistol has a frame, the slide mounted on the frame, a barrel mounted between the slide and the frame and a magazine for feeding cartridges into the chamber. The barrel has a chamber for receiving a cartridge from the magazine. The slide has a front portion for receiving the barrel, a breech face end and a block having an elongate passage for receiving a firing pin mechanism therein. A cam surface extends from a lower surface of the block, adjacent to the breech face end. The cam surface functions as a feed ramp for feeding live cartridges from the magazine to the chamber. The cam surface is a truncated hemispherical shaped protuberance having a flat surface thereon, the flat surface extending at an angle from the breech face. Positive separation of a spent cartridge casing and a topmost cartridge in the magazine is ensured when the spent cartridge casing is removed from the barrel during rearward movement of the slide. Positive contact between the breech face and a cartridge is ensured during forward movement of the slide for chambering of the cartridge.

In a second embodiment of the present invention, a slide for a semi-automatic pistol is provided. The pistol has a frame, the slide mounted on the frame, a barrel mounted between the slide and the frame, and a magazine for feeding cartridges into the chamber. The barrel has a chamber for receiving a cartridge from the magazine. The slide has a front portion for receiving the barrel, a breech face end and a block having an elongate passage for receiving a firing pin mechanism therein. A cam surface extends from a lower surface of the block, adjacent to the breech face end. The cam surface functions as a feed ramp for feeding live cartridges from the magazine to the chamber. The cam surface is a truncated hemispherical shaped protuberance. Again, positive separation of a spent cartridge casing and a topmost cartridge in the magazine is ensured when the spent cartridge casing is removed from the barrel during rearward movement of the slide. Positive contact between the breech face and a cartridge is ensured during forward movement of the slide for chambering of the cartridge.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The invention will be illustrated in more detail with reference to the following embodiments, but it should be understood that the present invention is not deemed to be limited thereto.

Figure 1:
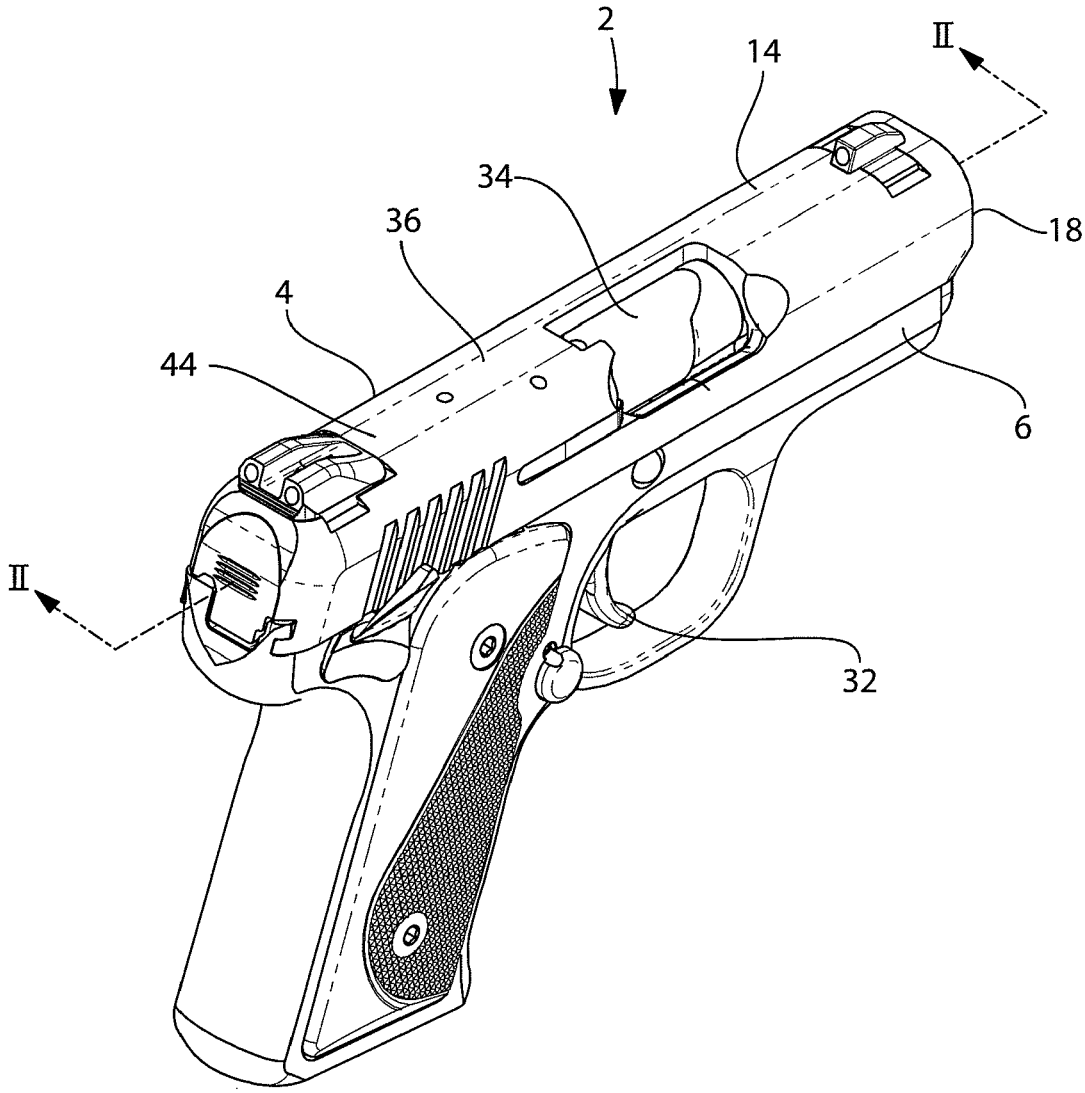
FIG. 1 is an isometric view of a pistol having a firearm slide cam surface for cartridge feed in accordance with a preferred embodiment of the present invention.
Figure 2:
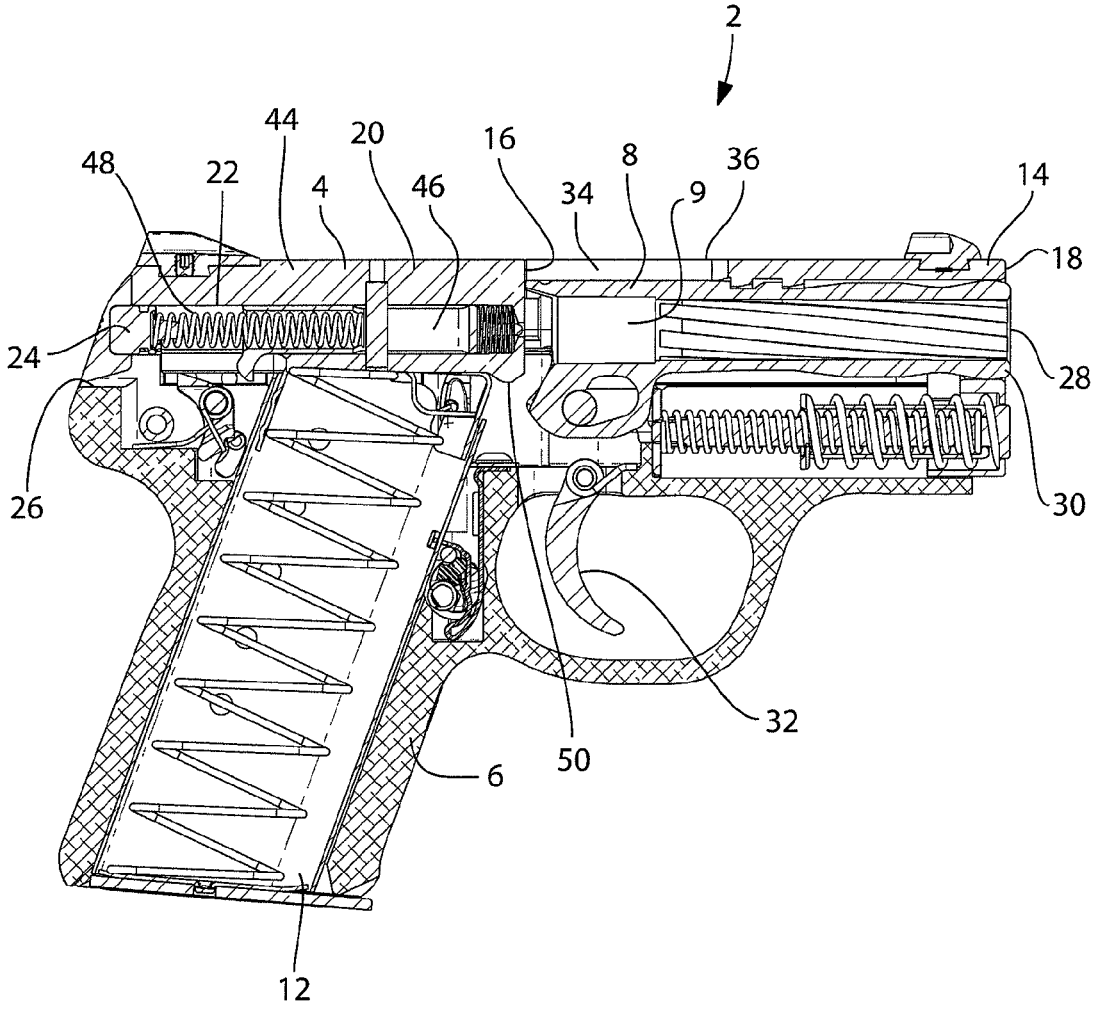
FIG. 2 is cross-sectional view of the pistol of FIG. 1, taken substantially along lines II-II of FIG. 1.
Figure 3:
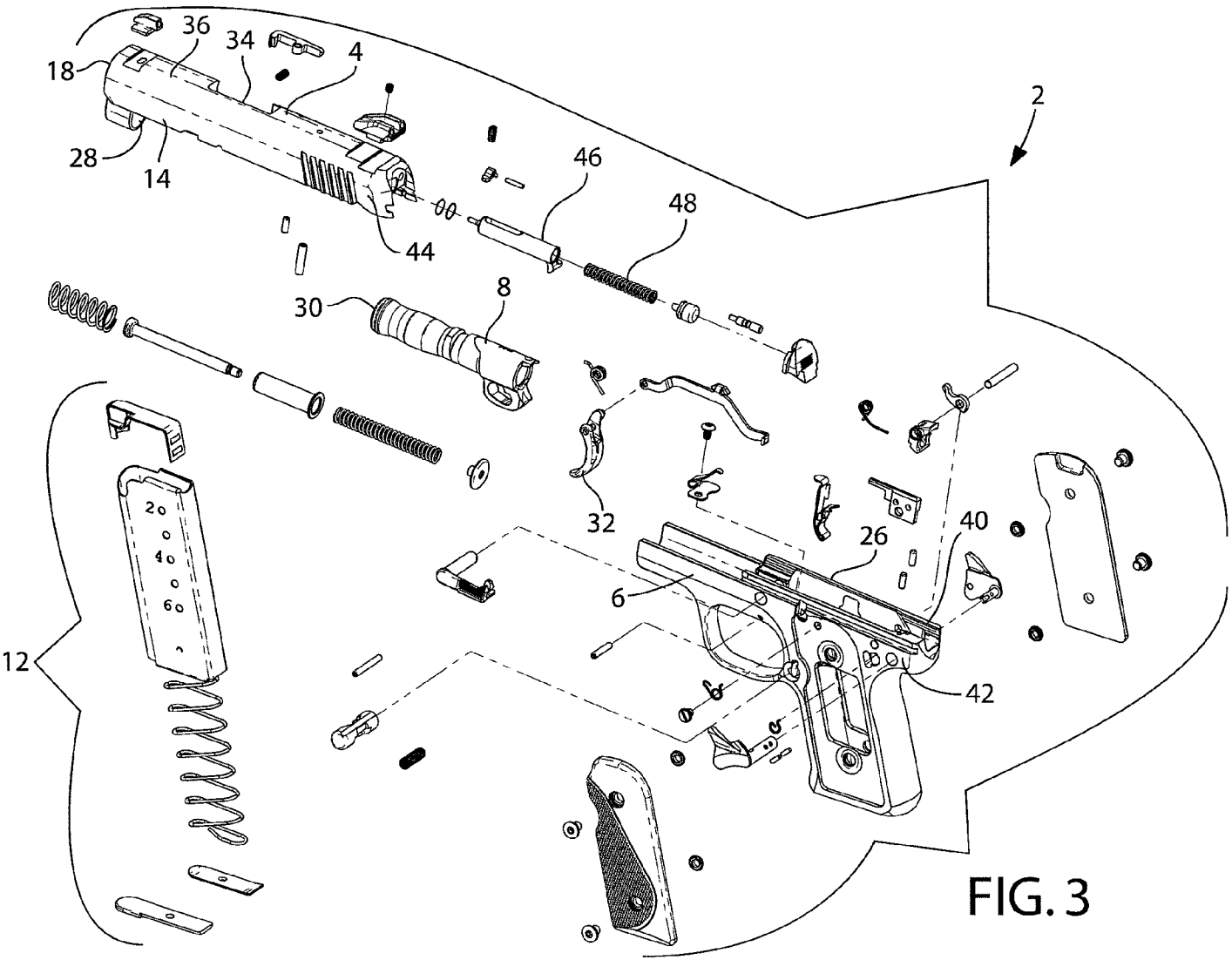
FIG. 3 is an exploded isometric view of the pistol of FIG. 1.

The present invention is directed to a novel element of a slide for a semi-automatic pistol. Specifically, the slide has a cam surface for improved cartridge feed. Referring now to the drawings, wherein like part numbers refer to like elements throughout the several views, there is shown in FIGS. 1-3 a pistol 2 having the novel slide 4 of the present invention. The pistol 2 has a frame 6 where the slide 4 is slidably mounted on the frame 6. A barrel 8 is mounted between the slide 4 and the frame 6 as is well known in the art of semi-automatic pistols. The barrel 6 has a chamber 9 for receiving a cartridge 10. A magazine 12 is provided for feeding cartridges 10 to the chamber 9. The slide 4 includes a front portion 14 for receiving the barrel 8 where the front portion 14 has a breech face end 16 and a front end 18. The slide 4 additionally has a block 20 which includes an elongate passage 22 for receiving a firing pin mechanism 24 therein.

The slide 4 is removably and slidably mounted on the top 26 of the frame 6. The slide 4 has a barrel hole 28, through which the front end 30 of the barrel 8 passes. The slide 4 is slidably mounted for reciprocal motion, as is well known. Firing the pistol 2, by pulling its trigger 32 drives the slide 14 toward the rear end 16 of the frame 6. The front end 30 of the barrel 8 passes through the barrel hole 28 and the casing 33 of the spent cartridge (see FIG. 6) is ejected through an aperture 34 on the top 36 of the slide 4.

The slide 4 is slidably mounted to the frame 6 using a tongue and groove feature. That is, the slide has recesses 38 to receive mating lugs 40 on the side edges 42 of the frame 6. The rear portion 44 of the slide 4 includes the block 20 with the elongate passage 22 for receiving the firing pin mechanism 24, including firing pin 46, spring 48 and related elements.

A significant novel feature of the present invention is a slide cam surface 50. As can be seen in FIGS. 4-7, 8A, 8B and 9, the slide 4 includes the cam surface 50 which is integral to the block 20 and extends from a lower surface 52 of the block 20 adjacent to the breech face end 16. The cam surface 50 functions as a feed ramp for feeding a topmost live cartridge 54 from the magazine 12 to the chamber 9.

Figure 4:
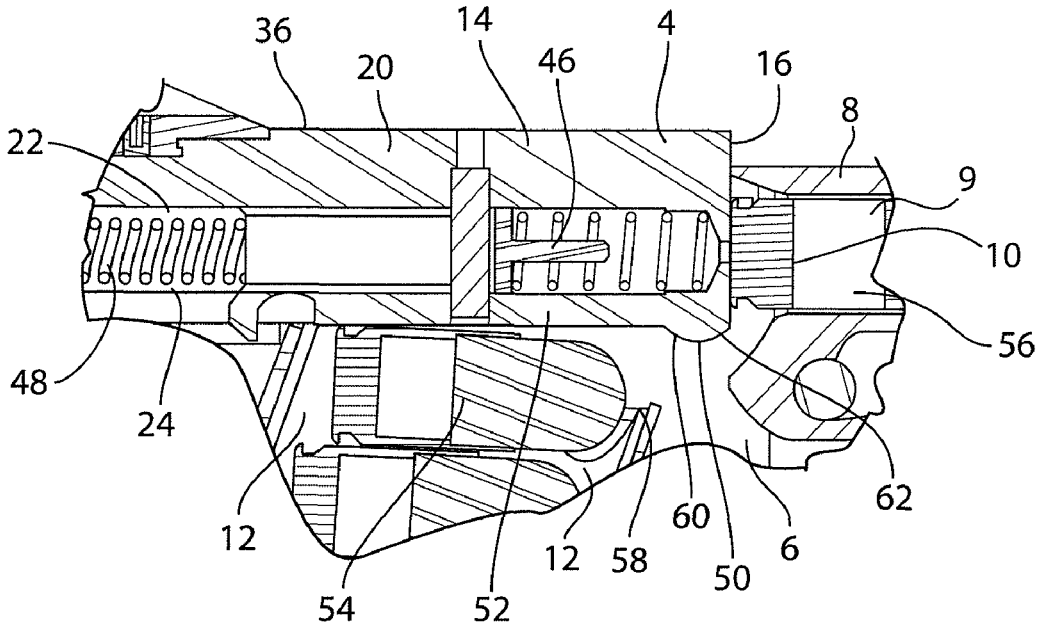
FIG. 4 is a partial expanded view of the cross-sectional view of FIG. 2 of the pistol of FIG. 1, shown with cartridges in the magazine and the chamber of the pistol, with the pistol in battery position.
Figure 5:
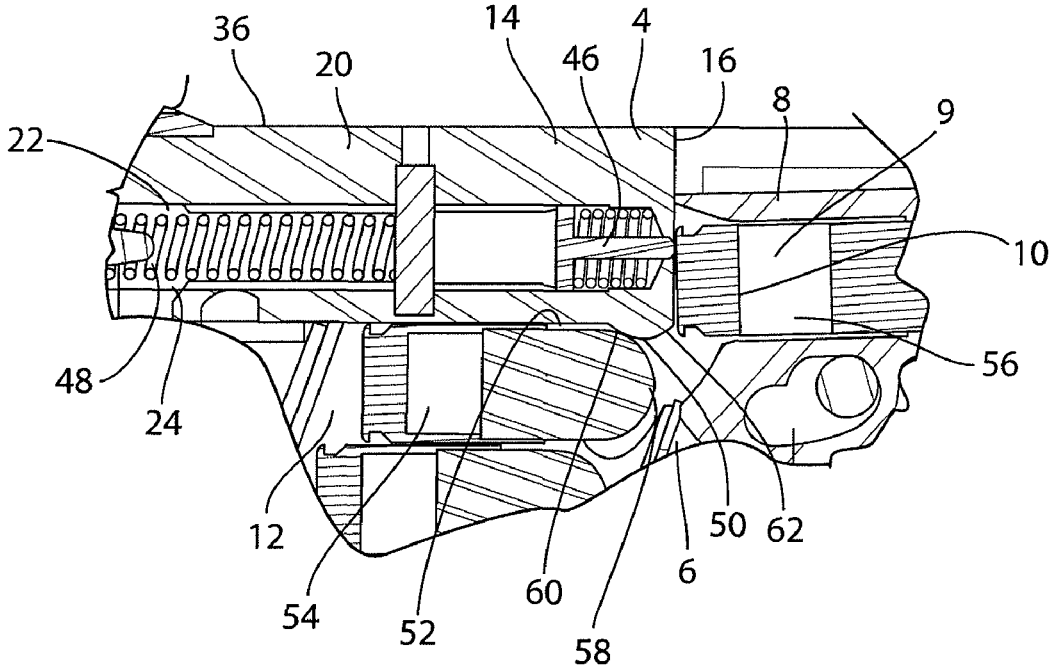
FIG. 5 is a partial expanded view of the cross-sectional view of FIG. 2 of the pistol of FIG. 1, shown with cartridges in the magazine and the chamber of the barrel of the pistol, with the pistol in an unlocked position.
Figure 6:
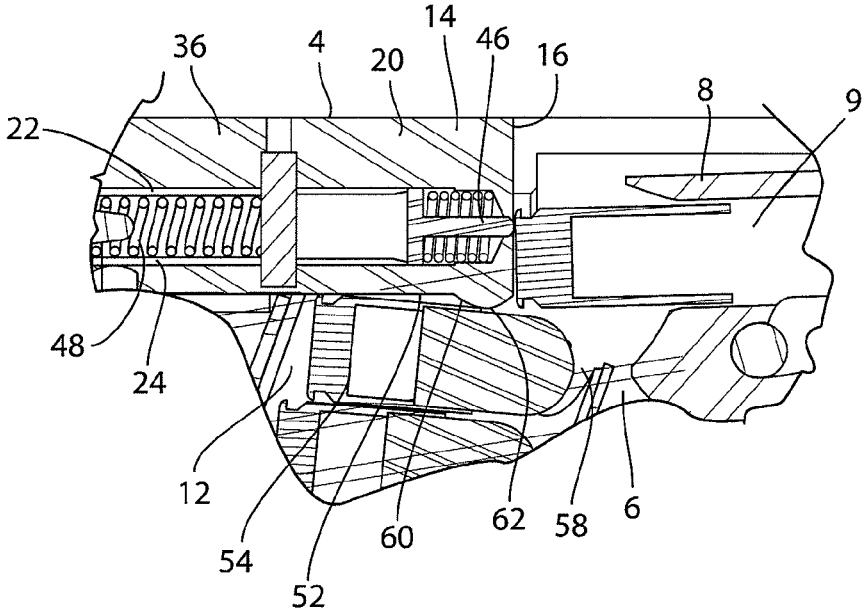
FIG. 6 is a partial expanded view of the cross-sectional view of FIG. 2 of the pistol of FIG. 1, shown with cartridges in the magazine and the chamber of the pistol, with the pistol in a position where a spent cartridge casing is in a position to be removed from the barrel.

FIGS. 4-6 show movement of the topmost live cartridge 54 relative to the frame 6, slide 4 and chambered cartridge 56 during a firing cycle. Specifically, FIG. 4 shows the pistol 10 in a battery position (i.e., where the slide 4 is completely closed relative to the frame 6, that is, it's most forward position, and the pistol will discharge if the firing mechanism is actuated with all safeties disengaged). Here, the chambered cartridge 56 is in the chamber 9 and the tip 58 the topmost cartridge 54 is adjacent to the cam surface 50, but not touching the cam surface. FIG. 5 shows the pistol 10 in an unlocked position where the slide 4 has begun its movement back relative to the frame 6 subsequent to firing. Here, the tip of the topmost cartridge 54 in the magazine has contacted the front side 60, but the cam surface 50 has not yet caused the topmost cartridge 54 to deflect downwardly. Finally, FIG. 6 depicts the pistol 10 in a position where movement of the slide 4 is causing removal of the casing 33 from the spent cartridge from the chamber 9 of the barrel 8.

Figure 7:
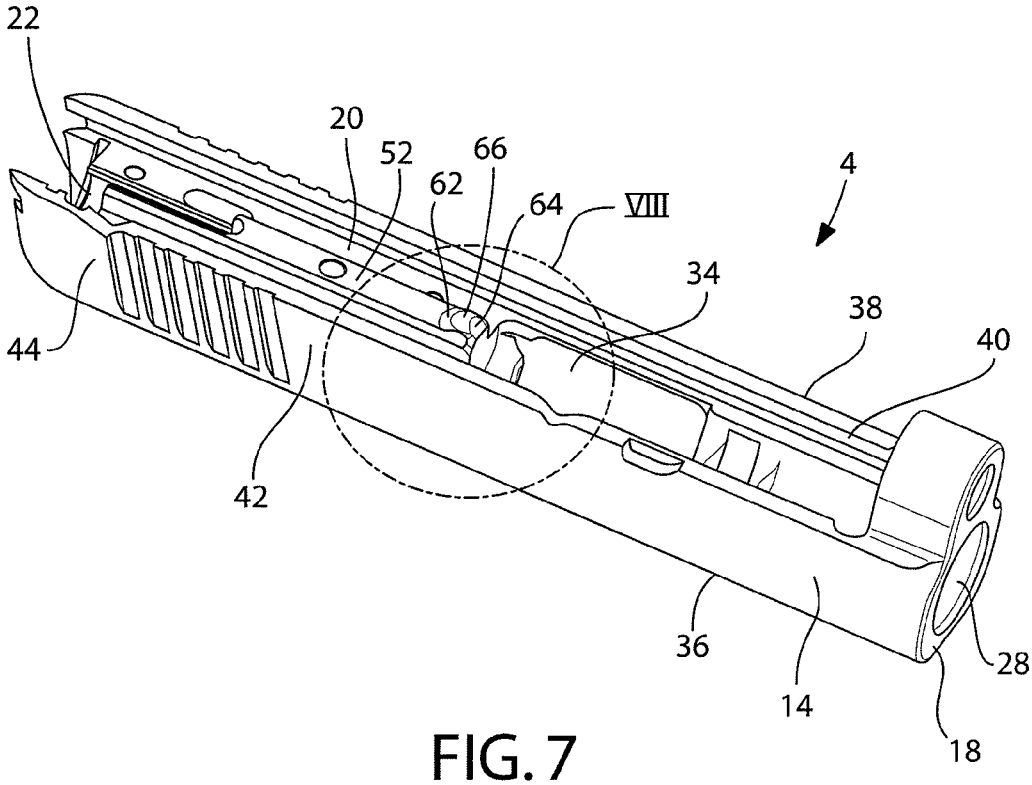
FIG. 7 is an isometric bottom view of a slide of the pistol of FIG. 1.
Figure 8A:
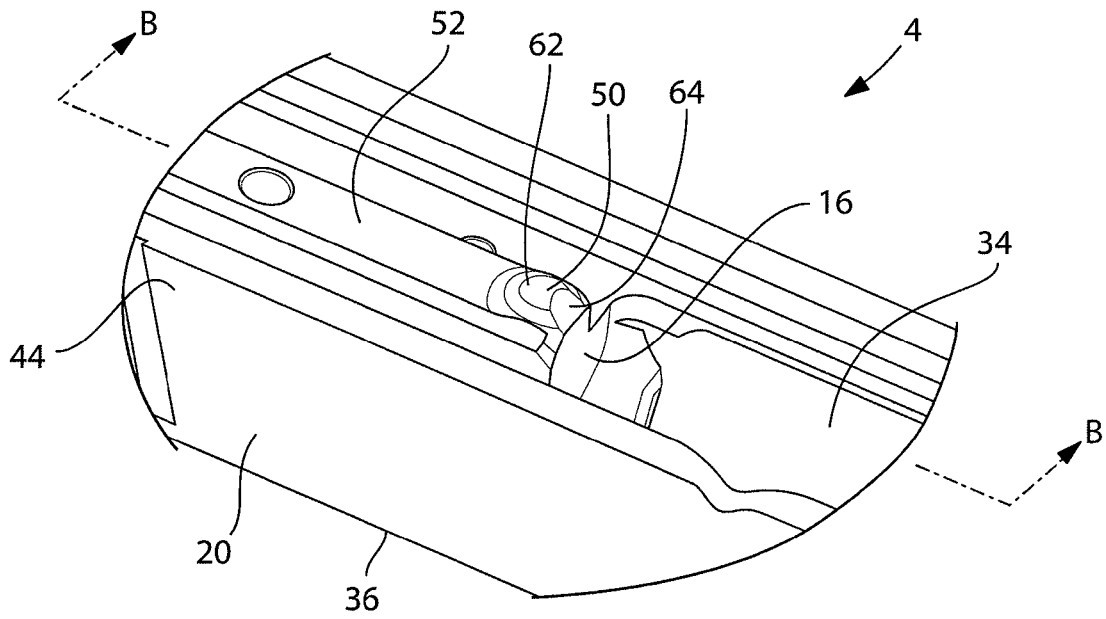
FIG. 8A is an isometric bottom detail view of a portion of the slide of the pistol of FIG. 1, as identified by detail VIII of FIG. 7.
Figure 8B:
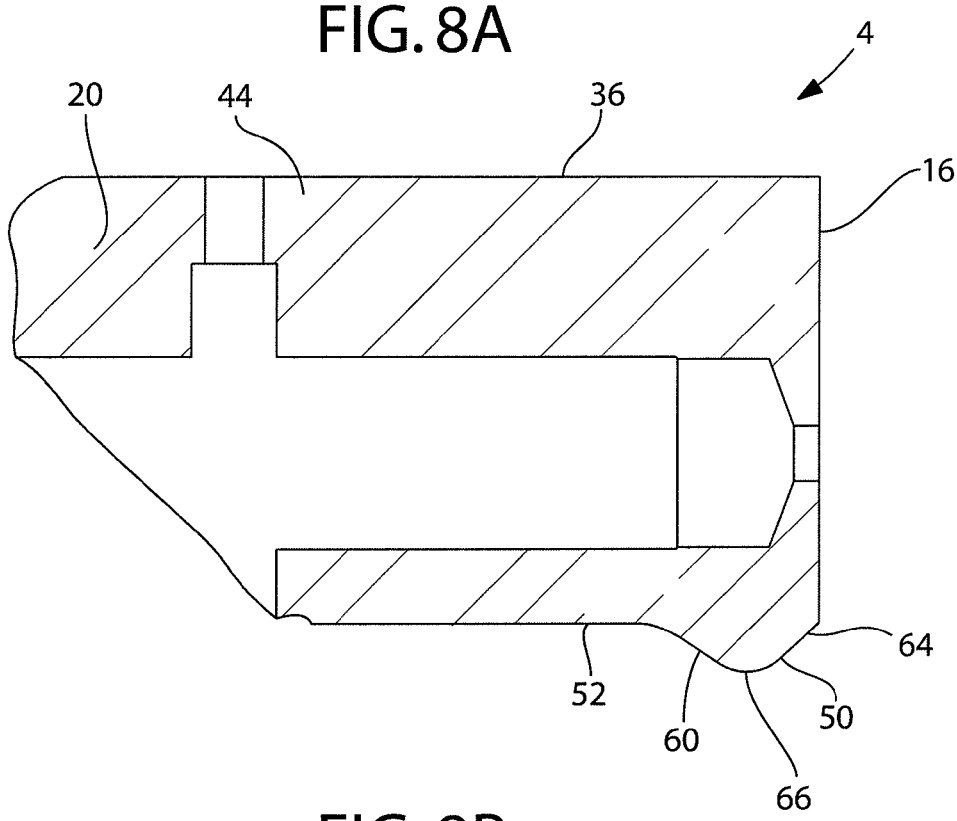
FIG. 8B is a cross-sectional view of a portion of the slide of FIG. 7, taken substantially along lines B-B of FIG. 8A, with the firing pin mechanism removed, for clarity.

In a first preferred embodiment of the present invention as can be seen most clearly in FIGS. 7, 8A and 8B, the cam surface 50 is a truncated hemispherical shaped protuberance 62 having a flat surface 64 thereon. It has been found that the flat surface 64 on the truncated hemispherical protuberance creates an ideal camming surface shape to properly deflect the topmost cartridge 54 first downwardly during rearward movement of the slide 4 relative to the frame 6, then, when the slide 4 moves forward relative to the frame 6 during a firing cycle, to properly move the cartridge 54 into proper position in the chamber 9. Here, the flat surface 64 extends at an angle from the breech face end 16 of the slide 4 to a position adjacent to the apex 66 of the hemispherical protuberance. The precise angle here depends on the geometry of the pistol 10 and is well within the skill of one of ordinary skill in the art to determine.

The truncated hemispherical shaped protuberances 62 having the flat surface 64 ensures positive contact between the breech face and the topmost cartridge 54 in the magazine during forward movement of the slide for chambering of the cartridge 54. More specifically, the truncated hemispherical shaped protuberance 62 provides positive separation of the topmost cartridge 54 and the chambered cartridge 56 during the feeding of each cartridge into the chamber 9 of the barrel 8 and during extraction of the casing 33 from the spent cartridge out of barrel 8.

The flat surface 64 creates an asymmetric surface configuration to provide a specific asymmetrical angular and horizontal position to topmost cartridge 54 in the magazine 12 to avoid contact with casing 33 during its extraction from the pistol 10 through the aperture 34. Additionally, the asymmetric surface configuration assures optimal angular position for the topmost cartridge 54 when the slide 4 feeds the topmost cartridge 54 into the chamber 9 of the barrel 8.

Figure 9:
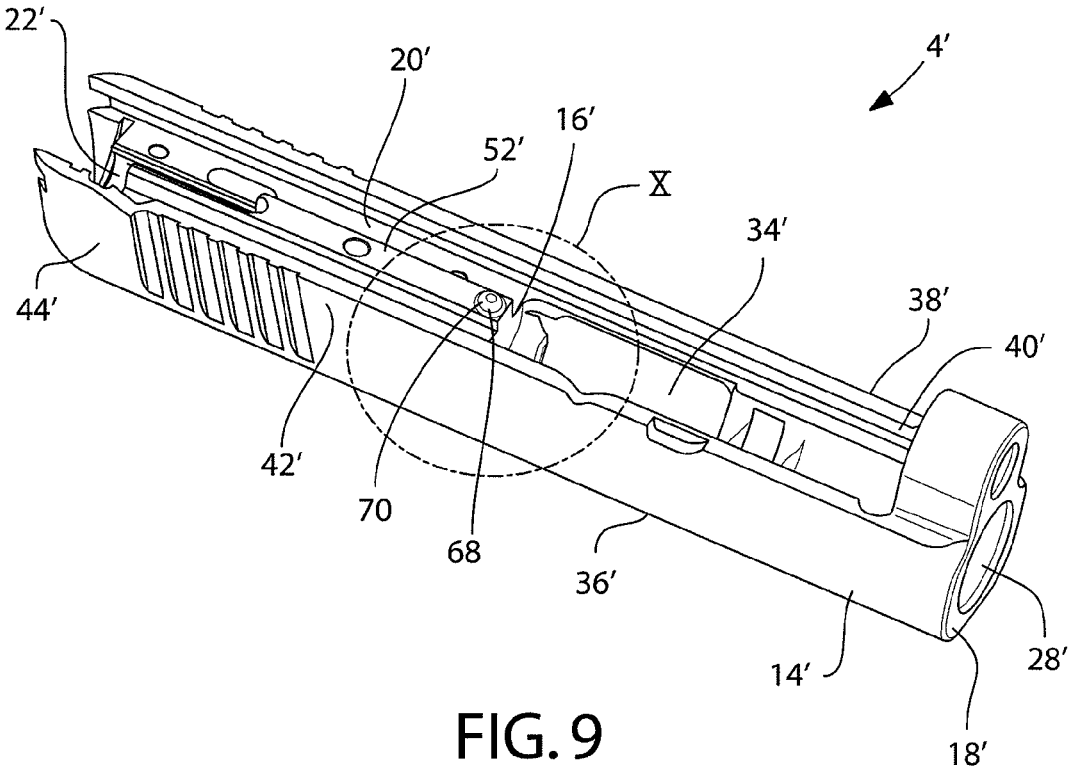
FIG. 9 is an isometric bottom view of an alternate embodiment of the a portion of slide of the pistol of FIG. 1.
Figure 10A:
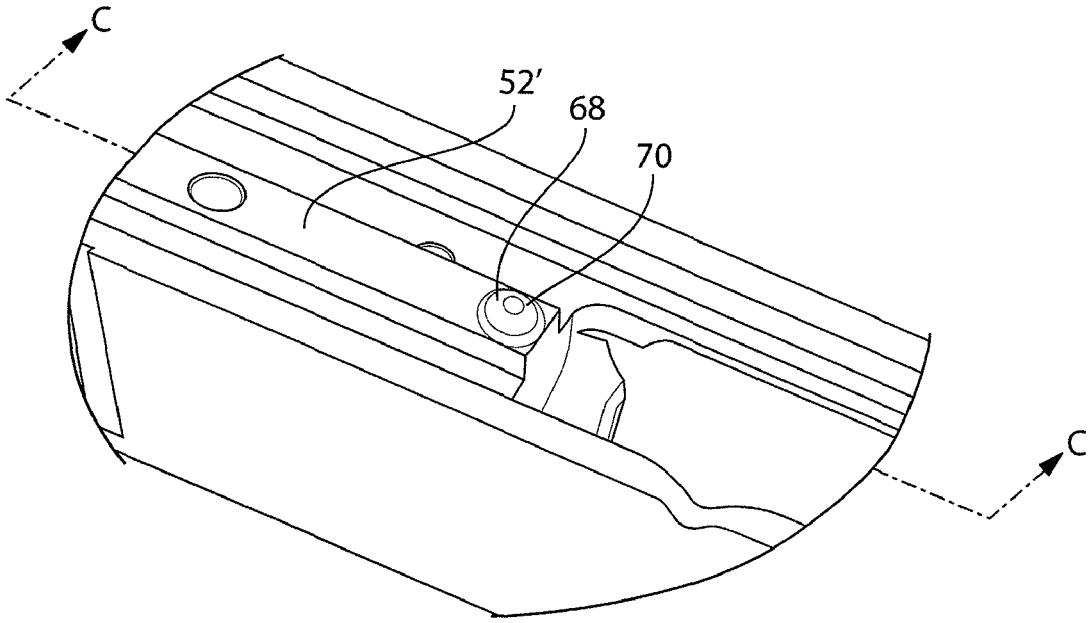
FIG. 10A is an isometric bottom detail view of a portion of the slide of the pistol of FIG. 1, as identified by detail X of FIG. 9.
Figure 10B:
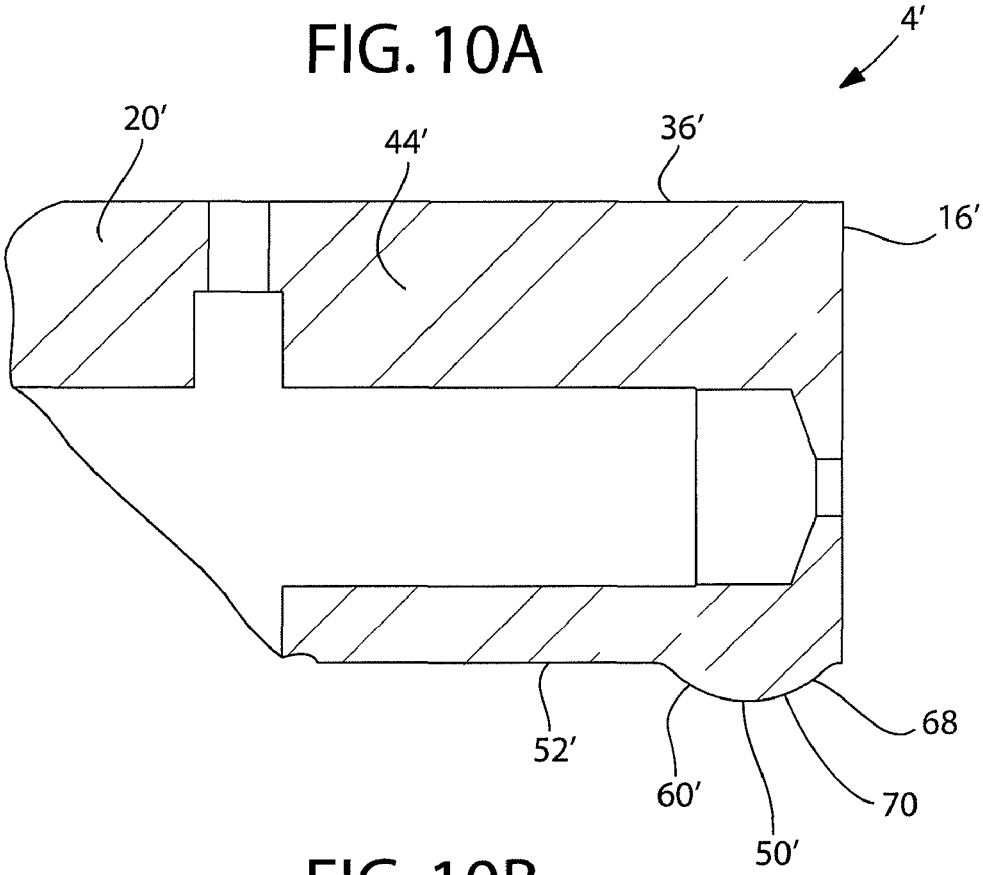
FIG. 10B is a cross-sectional view of the slide of FIG. 9, taken substantially along lines C-C of FIG. 10A, with the firing pin mechanism removed, for clarity.

In a second embodiment of the present invention, as shown in FIGS. 9, 10A and 10B, a different cam surface 68 is shown. For purposes of this embodiment, for the sake of simplicity, identical parts to those shown in the embodiment of FIGS. 4-7, 8A and 8B are used, but have a prime symbol associated with the reference number. For example, slide 4 of the first embodiment is designated slide 4' in the embodiment of FIGS. 9, 10A and 10B. Here, the cam surface 68 is a truncated hemispherical protuberance 70. However, no flat is present as in the embodiment of FIGS. 7, 8A and 8B. The end effect yields a properly functioning pistol with similar results as that of the first embodiment, but the hemispherical protuberance provides different and more symmetric movement of the topmost cartridge than that of the embodiment of FIGS. 7, 8A and 8B.

While the invention has been described in detail and with reference to specific examples thereof, it will be apparent to one skilled in the art that various changes and modifications can be made therein without departing from the spirit and scope thereof.

What is claimed is:

1. A slide for a semi-automatic pistol having a frame, a slide mounted on the frame, a barrel mounted between the slide and the frame, the barrel having a chamber for receiving a cartridge, and a magazine for feeding cartridges into the chamber, the slide comprising:

(a) a front portion for receiving the barrel having a breech face end and a front end;

(b) a block comprising an elongate passage for receiving a firing pin mechanism therein; and (c) a cam surface extending from a lower surface of the block adjacent to the breech face end, the cam surface functioning as a feed ramp for feeding live cartridges from the magazine to the chamber, the cam surface being a truncated hemispherical shaped protuberance having a flat surface thereon, said flat surface extending at an angle from the breech face;

whereby, positive separation of a spent cartridge casing and a topmost cartridge in the magazine is ensured when the spent cartridge casing is removed from the barrel during rearward movement of the slide, and positive contact between the breech face and a cartridge is ensured during forward movement of the slide for chambering of the cartridge.

2. A slide for a semi-automatic pistol having a frame, a slide mounted on the frame, a barrel mounted between the slide and the frame, the barrel having a chamber for receiving a cartridge, and a magazine for feeding cartridges into the chamber, the slide comprising:

(a) a front portion for receiving the barrel having a breech face end and a front end;

(b) a block comprising an elongate passage for receiving a firing pin mechanism therein; and (c) a cam surface extending from a lower surface of the block adjacent to the breech face end, the cam surface functioning as a feed ramp for feeding live cartridges from the magazine to the chamber, the cam surface being a truncated hemispherical shaped protuberance;

whereby, positive separation of a spent cartridge casing and a topmost cartridge in the magazine is ensured when the spent cartridge casing is removed from the barrel during rearward movement of the slide, and positive contact between the breech face and a cartridge is ensured during forward movement of the slide for chambering of the cartridge.

* * * * *